US010065439B2

(12) United States Patent
Nogami et al.

(10) Patent No.: US 10,065,439 B2
(45) Date of Patent: Sep. 4, 2018

(54) PRINTING APPARATUS

(71) Applicant: CANON KABUSHIKI KAISHA, Tokyo (JP)

(72) Inventors: Ryuji Nogami, Kawasaki (JP); Yasuhiro Ota, Chigasaki (JP); Kenji Soya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/653,505

(22) Filed: Jul. 18, 2017

(65) Prior Publication Data

US 2018/0029391 A1 Feb. 1, 2018

(30) Foreign Application Priority Data

Aug. 1, 2016 (JP) ..... 2016-151526

(51) Int. Cl.

| | |
|---|---|
| ***B41J 19/20*** | (2006.01) |
| ***B41J 2/17*** | (2006.01) |
| ***B41J 25/308*** | (2006.01) |
| ***B41J 25/312*** | (2006.01) |
| *B41J 29/02* | (2006.01) |
| *B41J 29/393* | (2006.01) |

(52) U.S. Cl.

CPC ..... *B41J 19/205* (2013.01); *B41J 2/1707* (2013.01); *B41J 25/3086* (2013.01); *B41J 25/312* (2013.01); *B41J 29/02* (2013.01); *B41J 29/393* (2013.01)

(58) Field of Classification Search

CPC ..... B41J 19/205; B41J 25/3086; B41J 25/312

See application file for complete search history.

(56) References Cited

U.S. PATENT DOCUMENTS

| | | | | |
|---|---|---|---|---|
| 9,662,887 | B2 | 5/2017 | Saito et al. | |
| 2006/0192804 | A1* | 8/2006 | Nakata | B41J 11/003 347/16 |

FOREIGN PATENT DOCUMENTS

| | | | |
|---|---|---|---|
| JP | 2005-335937 | A | 8/2005 |
| JP | 2016-043582 | A | 4/2016 |

* cited by examiner

*Primary Examiner* — Juanita D Jackson

(74) *Attorney, Agent, or Firm* — Fitzpatrick, Cella, Harper & Scinto

(57) ABSTRACT

A printing apparatus includes a printhead on a movable carriage; an operating unit operating by a driving force of a driving source; a transmitting unit being displaced by the driving force between a position where the transmitting unit transmits the driving force to the operating unit and a non-transmitting position; a movable member arranged on a moving path of the carriage; a restricting member being displaced, in coordination with a displacement of the movable member, between a position where the displacement of the transmitting unit is restricted and a non-restricting position; and a selecting member provided between the movable member and the restricting member. The selecting member is displaced between a position where the movable member and the restricting member are coordinated with each other by the selecting member and a non-coordinating position.

12 Claims, 10 Drawing Sheets

PRINTING APPARATUS

BACKGROUND OF THE INVENTION

Field of the Invention

The present invention relates to a printing apparatus.

Description of the Related Art

In a serial printing apparatus, there is proposed a mechanism of switching an operation using the movement of a carriage. For example, Japanese Patent Laid-Open No. 2005-335937 discloses a mechanism of restricting and canceling intermittent switching of a driving force to a feeding device by the displacement of a member along with the movement of a carriage. In addition, Japanese Patent Laid-Open No. 2016-43582 discloses a mechanism of performing a capping operation and the like for a printhead by the displacement of a member along with the movement of a carriage.

If a single driving source is commonly used as the driving sources of a plurality of mechanisms, the plurality of mechanisms may be required to be exclusively driven. As in the technique described in Japanese Patent Laid-Open No. 2005-335937, in the arrangement in which restriction of intermittent switching of a driving force to the feeding device is canceled when the carriage reaches a specific position, while the carriage is located at the specific position, the driving force to the feeding device can be transmittable. Consequently, while the carriage is located at the specific position, it may be difficult to exclusively drive the feeding device and another mechanism by a single driving source.

SUMMARY OF THE INVENTION

The present invention provides a technique capable of switching and selecting an operation in a mechanism of switching an operation using the movement of a carriage.

According to one aspect of the present invention, there is provided a printing apparatus comprising a printhead configured to print an image on a printing medium; a carriage, on which the printhead is mounted, configured to move; a driving source; an operating unit configured to operate by a driving force of the driving source; a transmitting unit configured to be displaced by the driving force of the driving source between a transmitting position at which the transmitting unit transmits the driving force of the driving source to the operating unit and a non-transmitting position at which the transmitting unit does not transmit the driving force of the driving source to the operating unit; a movable member arranged on a moving path of the carriage and configured to be displaced by the movement of the carriage; a restricting member configured to be displaced, in coordination with a displacement of the movable member, between a restricting position at which the displacement of the transmitting unit is restricted by the restricting member and a non-restricting position; and a selecting member provided between the movable member and the restricting member and configured to be displaced between a coordinating position at which the movable member and the restricting member are coordinated with each other by the selecting member and a non-coordinating position at which the movable member and the restricting member are not coordinated with each other by the selecting member.

Further features of the present invention will become apparent from the following description of exemplary embodiments (with reference to the attached drawings).

DESCRIPTION OF THE EMBODIMENTS

<Overall Arrangement>

Figure 1A:
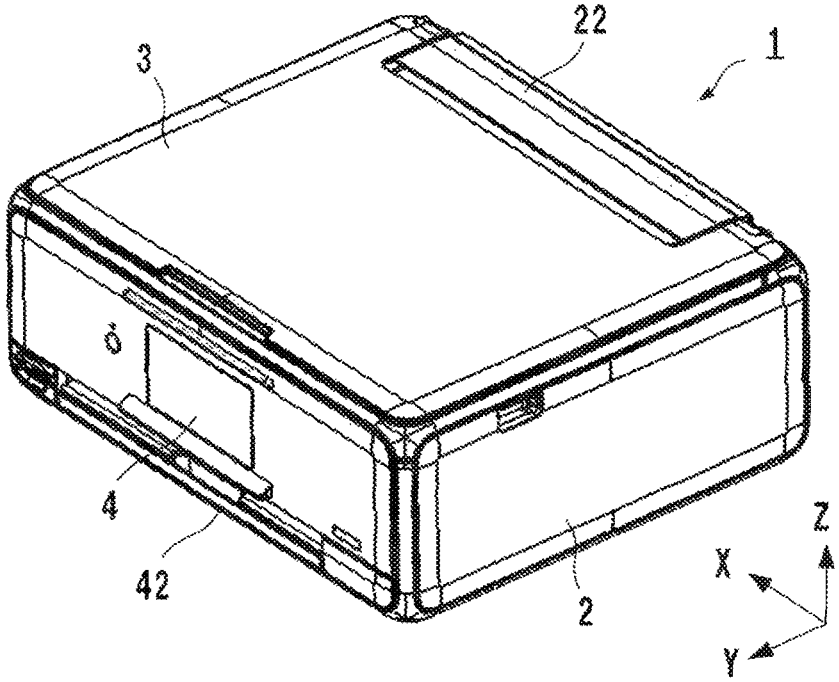
FIG. 1A is a perspective view showing the outer appearance of a printing apparatus according to an embodiment of the present invention.
Figure 1B:
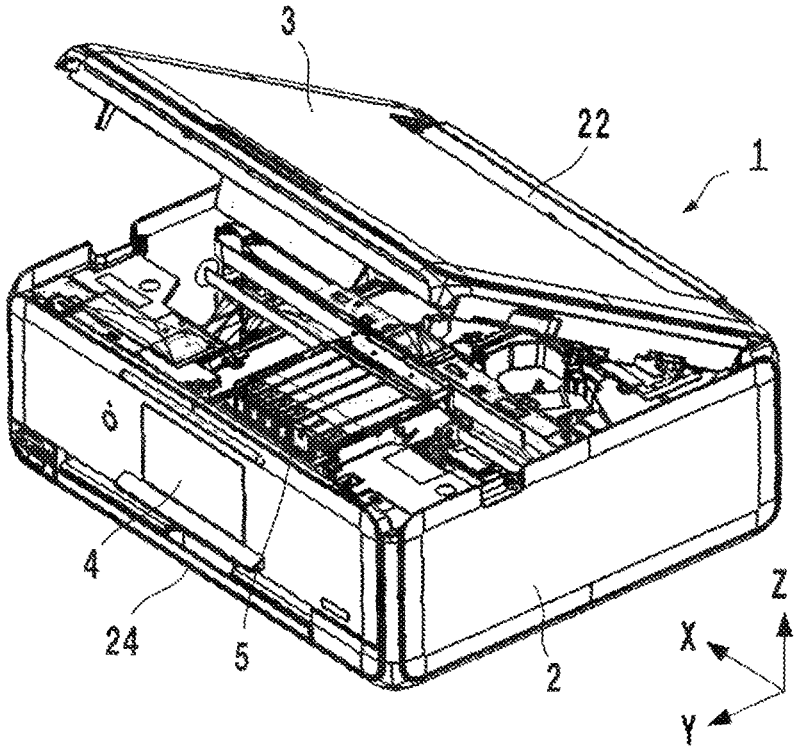
FIG. 1B is a perspective view showing, in an open state, the outer appearance of the printing apparatus shown in FIG. 1A.

FIG. 1A is a perspective view showing the outer appearance of a printing apparatus 1 according to an embodiment of the present invention. The printing apparatus 1 has a rectangular parallelepiped shape as a whole. A scanner unit 3 is provided on a main body 2 to be capable of opening/closing. A display device 4 of touch panel type configured to accept a user operation is provided on the front surface of the main body 2. FIG. 1B shows a state in which the scanner unit 3 is opened, illustrating a form when exchanging a plurality of types of ink tanks 5 detachably incorporated in the printing apparatus 1. In FIGS. 1A and 1B, arrows X, Y, and Z indicate the widthwise direction, the depth direction, and the height direction of the printing apparatus 1, respectively, which are directions crossing each other (here, directions orthogonal to each other). This also applies to the arrows X, Y, and Z in other drawings.

The printing apparatus 1 is a serial inkjet printing apparatus that prints an image by discharging inks supplied from the ink tanks 5 to a printing medium. However, the present invention is also applicable to a serial printing apparatus of another type. Note that "print" includes not only formation of significant information such as a character or graphic pattern but also formation of an image, design, or pattern on a printing medium in a broader sense or processing of a printing medium regardless of whether the information is significant or insignificant or has become obvious to allow human visual perception. In this embodiment, a "printing medium" is assumed to be a paper sheet but may be a fabric, plastic film, or the like.

Figure 2:
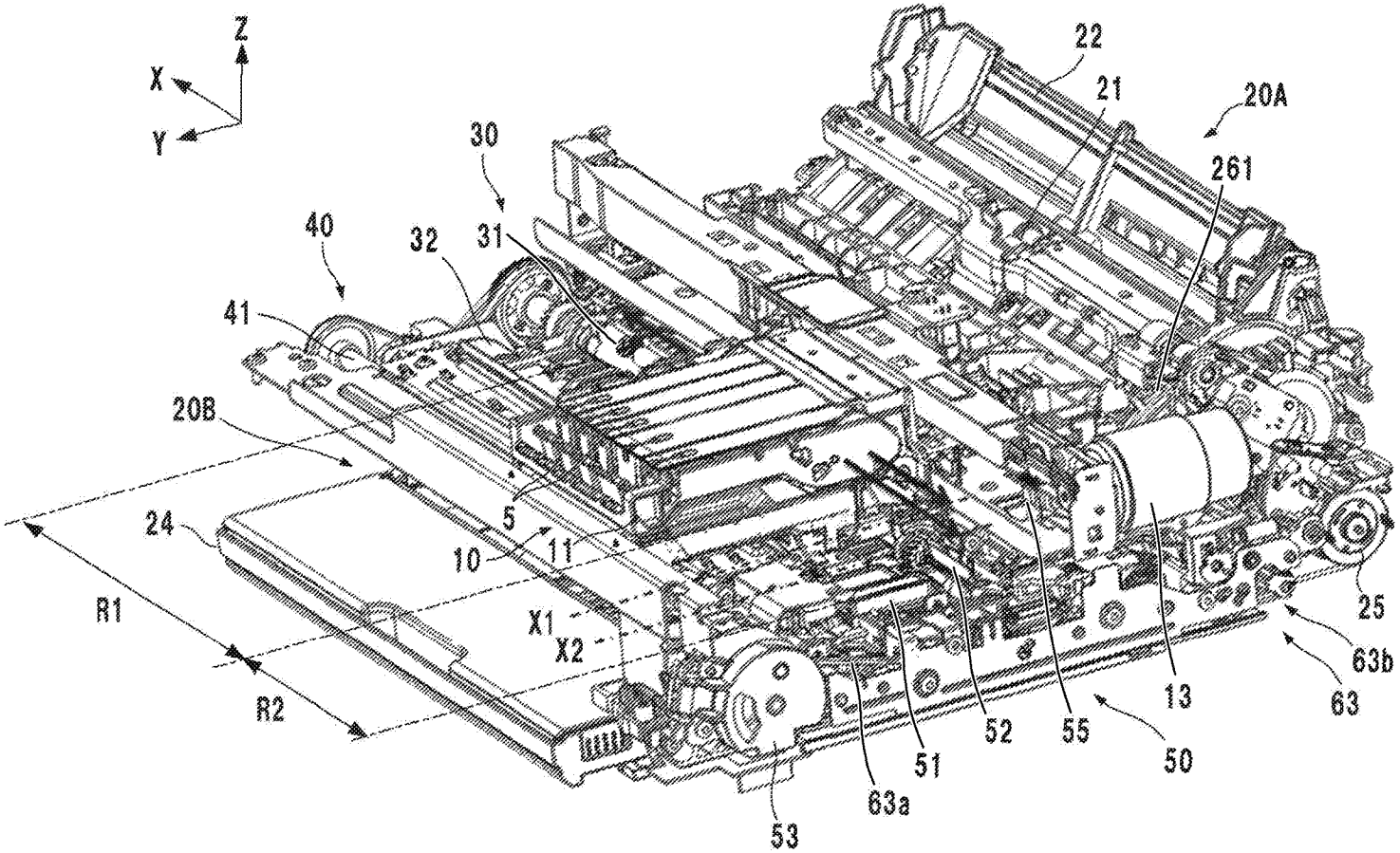
FIG. 2 is a perspective view showing the internal mechanism of the printing apparatus shown in FIG. 1A.

FIG. 2 is a perspective view showing the internal mechanism of the printing apparatus 1. The printing apparatus 1 includes a printing unit 10, feeding units 20A and 20B, a conveying unit 30, a discharging unit 40, and a recovery unit 50.

The feeding units 20A and 20B, the conveying unit 30, and the discharging unit 40 are mechanisms configured to convey a printing medium. The conveyance direction will be referred to as a sub-scanning direction, and the conveyance source will sometimes be referred to as an upstream side, and the conveyance destination as a downstream side. In this embodiment, the sub-scanning direction is the Y direction in the planar view of the printing apparatus 1.

The printing apparatus 1 includes two feeding paths. One of them is formed by the feeding unit 20A and the other is formed by the feeding unit 20B. The feeding unit 20A includes a feeding roller 21 extending in the X direction. The feeding roller 21 is rotated by the driving force of a driving source 25 (in this embodiment, a motor) and can convey a printing medium stacked on a stacking table 22. The stacking table 22 is arranged on the rear side of the main body 2, and can be opened from a close state shown in FIG. 1A and the like to an open state shown in FIG. 2.

The feeding unit 20B includes a feeding cassette 24 detachably mounted in the bottom portion of the printing apparatus 1 from the front side, and feeds a printing medium stored in the feeding cassette 24 to the conveying unit 30 around the rear side of the printing apparatus 1.

The conveying unit 30 is arranged on the downstream side of the feeding unit 20A. The conveying unit 30 includes a conveying roller 31 extending in the X direction. The conveying roller 31 is rotated by the driving force of a driving source 32 (in this embodiment, a motor) and conveys the printing medium conveyed from the feeding unit 20A or 20B. A driven roller is pressed against the conveying roller 31. The printing medium is conveyed while being sandwiched by the nip portion between the conveying roller 31 and the driven roller.

The discharging unit 40 is arranged on the downstream side of the conveying unit 30. The discharging unit 40 includes a discharging roller 41 extending in the X direction. The discharging roller 41 is rotated by the driving force of the driving source 32, and discharges the printing medium conveyed from the conveying unit 30.

Figure 3A:
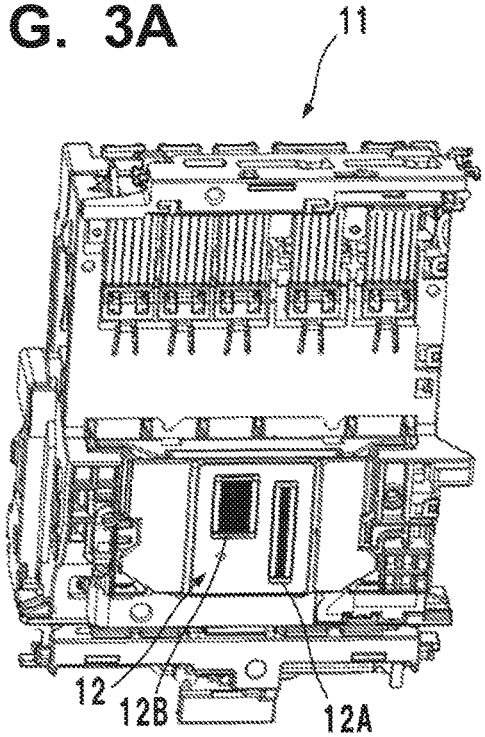
FIG. 3A is a perspective view showing the bottom surface side of a carriage.

The printing unit 10 is a mechanism configured to print an image on a printing medium. The printing unit 10 includes a carriage 11. The plurality of types of ink tanks 5 are detachably mounted on the carriage 11. As shown in FIG. 3A, a printhead 12 is mounted in the carriage 11. The printhead 12 can be either detachable or fixed to the carriage 11.

The printhead 12 is provided in the bottom portion of the carriage 11. The printhead 12 includes a plurality of orifices to discharge ink. The printhead 12 discharges inks supplied from the ink tanks 5 to the printing medium conveyed by the conveying unit 30, thereby printing an image. In this embodiment, the printhead 12 includes printheads 12A and 12B arranged in the X direction. The printheads 12A and 12B discharge different types of inks. The printhead 12A discharges, for example, black pigment ink. The printhead 12B discharges, for example, color dye inks. A surface where ink orifices are formed will sometimes be referred to as an ink discharge surface. In this embodiment, the lower surface of each of the printheads 12A and 12B is the ink discharge surface.

The printing unit 10 includes a driving mechanism that reciprocally moves the carriage 11 in a predetermined direction. The reciprocal moving direction of the carriage 11 will be referred to as a main scanning direction that is the X direction in this embodiment. The movement of the carriage 11 will be referred to as scanning. Printing an image by the printhead 12 while moving the carriage 11 will be referred to as print scanning in some cases.

The driving mechanism of the carriage 11 includes, for example, a guide rail that guides the movement of the carriage 11 in the main scanning direction, and a belt transmitting mechanism that transmits the driving force from a driving source 13 (in this embodiment, a motor) to the carriage 11 and moves it in the main scanning direction.

The recovery unit 50 is a mechanism configured to maintain and recover the ink discharge performance of the printhead 12. The recovery unit 50 includes a cap 51 and a wiper 52. In this embodiment, preliminary discharge and cleaning can be performed as the maintenance/recovery of the ink discharge performance of the printhead 12. In this embodiment, preliminary discharge is an operation of discharging ink from the printhead 12. In this embodiment, cleaning includes an operation of capping the printhead 12 with the cap 51 and sucking ink from the printhead 12 by a negative pressure and an operation (wiping) of wiping the ink discharge surface of the printhead 12 by the wiper 52.

The recovery unit 50 is arranged at one end of the main body 2 in the X direction. When the carriage 11 moves, the printhead 12 moves across a printing region R1 and a standby region R2 adjacent to the printing region R1 in the main scanning direction. The recovery unit 50 is arranged in the standby region R2. The printing region R1 is a region where the printhead 12 moves to print an image on the printing medium, and is a region corresponding to the conveying path of the printing medium. The standby region R2 is a region outside the conveying path of the printing medium, and is a region where the printhead 12 is located while standing by for next printing.

In this embodiment, two positions, that is, positions X1 and X2, are set as the stop positions of the printhead 12 in the standby region. The position X2 is a cleaning position at which cleaning of the printhead 12 is performed, and is the initial position (home position) of the printhead 12 according to this embodiment. The position X1 is a preliminary discharge position at which preliminary discharge of the printhead 12 is performed. The position X1 is set to be closer to the printing region R1 in the main scanning direction than the position X2. The fact that the printhead 12 is located at the position X1 or X2 means that the carriage 11 is located at the position X1 and X2.

Image printing on the printing medium by the printing apparatus 1 can be performed, for example, in the following way. The printing medium fed from the feeding unit 20A or 20B is intermittently conveyed by the conveying unit 30, and printing medium conveyance and image printing by the printing unit 10 are alternately performed. More specifically, the printing medium is conveyed by the conveying unit 30 to a row position (a position in the sub-scanning direction) where an image is formed and stops. During the stop of conveyance of the printing medium, the carriage 11 is moved to perform print scanning. Next, the conveying unit 30 conveys the printing medium to the next row position, and the same procedure as described above is repeated. The image can thus be printed on the entire surface of the printing medium. When the image printing ends, the printing medium is discharged by the discharging unit 40.

Preliminary discharge of the printhead 12 can be done by moving the printhead 12 to the position X1 after print scanning is performed once or a plurality of times. Cleaning of the printhead 12 can be done at the start of print job execution or between pages.

<Recovery Unit>

Figure 3B:
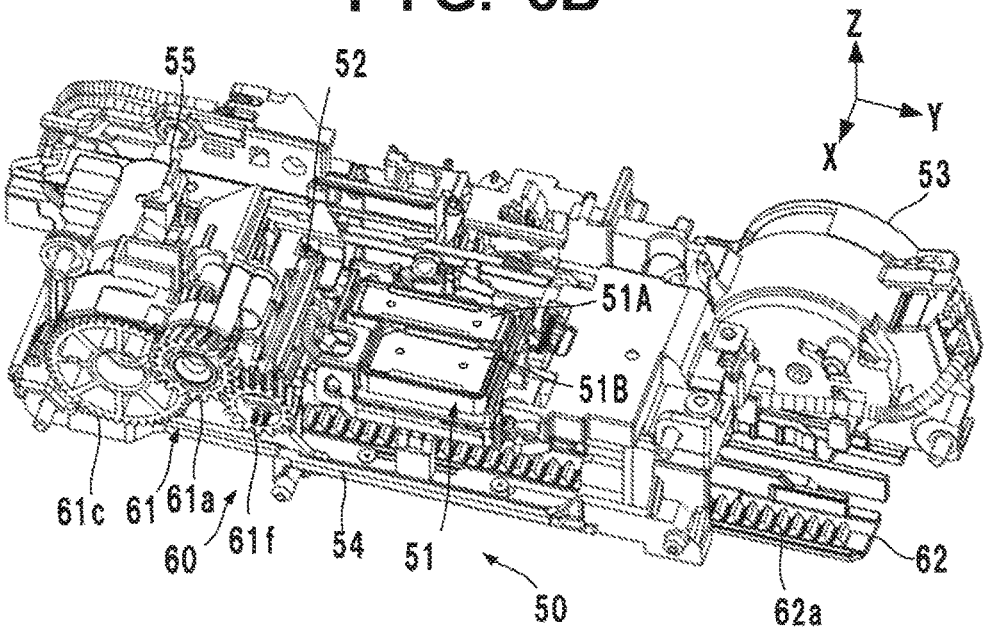
FIG. 3B is a perspective view showing a recovery unit.

The arrangement of the recovery unit 50 will be described with reference to FIGS. 2 and 3B. FIG. 3B is a perspective view showing the arrangement of part of the recovery unit 50.

The recovery unit 50 includes a base member 54, and components are supported by the base member 54 directly or via another member. The base member 54 is a frame integrally formed as a whole by, for example, a resin material.

The recovery unit 50 includes the cap 51 that sucks ink from the printhead 12. In this embodiment, the cap 51 includes a cap 51A corresponding to the printhead 12A, and a cap 51B corresponding to the printhead 12B.

The cap 51A is a cup-shaped member capable of hermetically covering the ink discharge surface of the printhead 12A, and is made of, for example, a flexible material such as rubber. Holes for negative pressure suction of ink and holes for atmosphere communication are formed in the caps 51A and 51B, respectively. The holes for negative pressure suction of ink are connected to a pump 53 via tubes with flexibility. By driving the pump 53, ink in the printheads 12A and 12B can be sucked by a negative pressure. The holes for atmosphere communication are connected to an air valve (not shown) via tubes with flexibility. The air valve can close/release the tubes, thereby switching the holes for atmosphere communication between a state in which the holes communicate with the atmosphere and a state in which the holes do not communicate with the atmosphere.

The recovery unit 50 includes the wiper 52. The wiper 52 is a blade-shaped member that moves in the Y direction and wipes the ink discharge surface of the printhead 12 located at the position X2, and is made of, for example, a flexible material such as rubber.

As shown in FIG. 2, the pump 53 is driven by the driving source 25 via a belt transmitting mechanism 63 provided in the side portion of the recovery unit 50. That is, in this embodiment, the feeding units 20A and 20B and the pump 53 commonly use the driving source 25. The belt transmitting mechanism 63 includes a pulley mechanism 63*b* and a belt 63*a* wound around the pulley mechanism 63*b* and the pump 53. The pulley mechanism 63*b* is formed from a plurality of pulleys. One of the pulleys is rotated by the driving force of the driving source 25 to cause the belt 63*a* to travel, thereby driving the pump 53.

The recovery unit 50 includes a driving mechanism 60. The driving mechanism 60 includes a gear device 61 to which the driving force from the driving source of the recovery unit 50 is input, and a control member 62 that is driven by the input driving force. In this embodiment, the driving source 32 that drives the conveying roller 31 is commonly used as the driving source of the recovery unit 50.

A recovery driving member 55 switches transmission of the driving force to the recovery unit 50 of the driving source 32. The recovery driving member 55 is arranged on the moving path of the carriage 11, is a movable member that is displaced by the movement of the carriage 11, and is provided to be translatable in the X direction. When the carriage 11 moves from the position X1 to the position X2, the carriage 11 abuts against the recovery driving member 55, and the movement of the carriage 11 displaces the recovery driving member 55.

In the following description, the fact that the recovery driving member 55 is located at the position X1 indicates that the recovery driving member 55 is in contact with the carriage 11 at the position X1. The fact that the recovery driving member 55 is located at the position X2 indicates that the movement of the carriage 11 to the position X2 has displaced the recovery driving member 55 to the corresponding position.

Figure 4A:
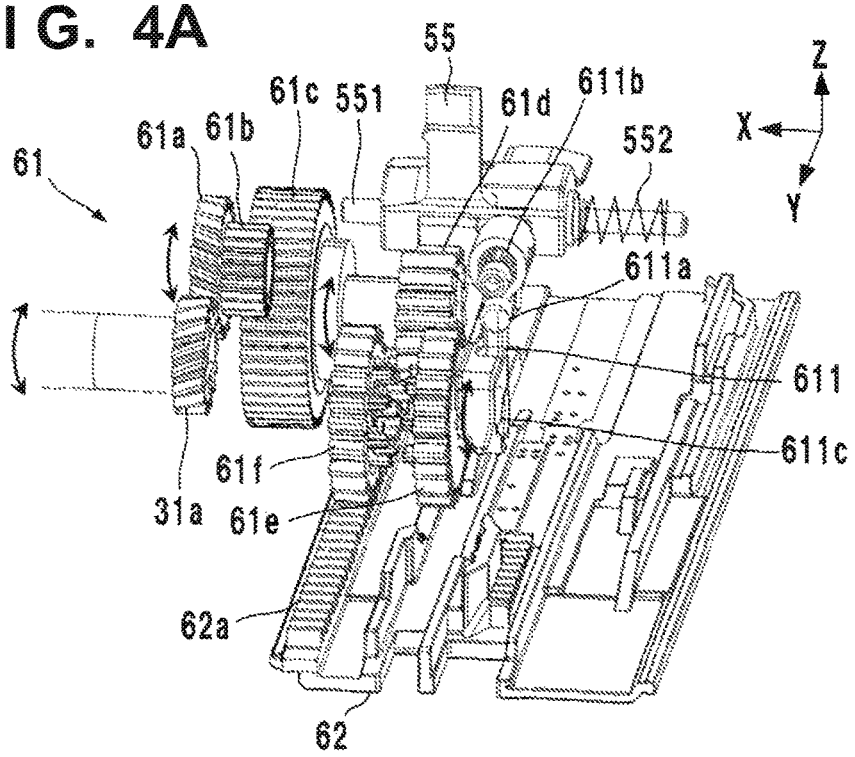
FIGS. 4A and 4B are explanatory views of the driving mechanism of the recovery unit.
Figure 4B:
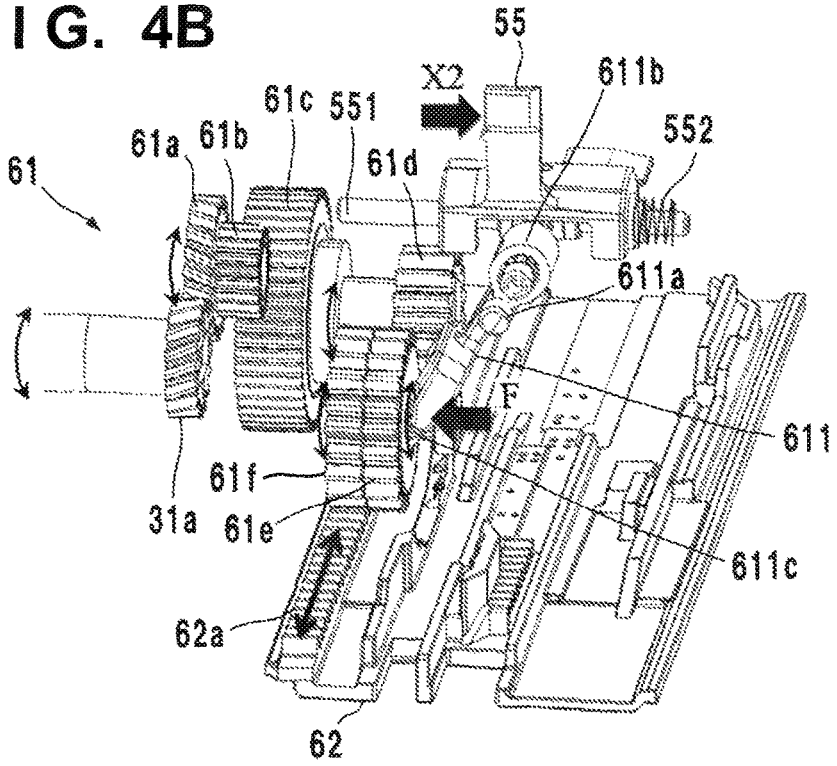

The displacement of the recovery driving member 55 inputs the driving force of the driving source 32. This mechanism will be further described with reference to FIGS. 4A and 4B. FIGS. 4A and 4B are explanatory views of the peripheral arrangement of the gear device 61 and recovery driving member.

The recovery driving member 55 is slidably supported by a guide shaft 551 extending in the X direction. A spring 552 is provided between the recovery driving member 55 and the base member 54. The spring 552 biases the recovery driving member 55 to the position X1.

One end 611*b* of a recovery driving arm 611 is pivotably attached to the recovery driving member 55. The recovery driving arm 611 is pivotably supported around a shaft 611*a* in the Y direction. A gear 61*e* is pivotably and rotatably supported around an X-direction axis by the other end 611*c* of the recovery driving arm 611.

The gear 61*e* is arranged to face a gear 61*f*. These gears form a clutch. More specifically, an engaging portion is formed on each of the end face of a gear 61*a* and the end face of the gear 61*f*. When the end faces contact each other, the engaging portions are set in an engaging state, thereby enabling driving transmission. When the end faces are separated from each other, the engaging portions are set in a non-engaging state, thereby disabling driving transmission.

A gear 31*a* is fixed to the end portion of the shaft of the conveying roller 31, and meshes with the gear 61*a*. The gear 61*a* is rotatably supported around the X-direction axis. A gear 61*b* is coaxially fixed to the gear 61*a*. The gear 61*b* meshes with a gear 61*c*. The gear 61*c* is rotatably supported around the X-direction axis. A gear 61*d* is coaxially fixed to the gear 61*c*. The gear 61*d* meshes with the gear 61*e*.

FIG. 4A shows a state in which the recovery driving member 55 is located at the position X1. In this state, the gear 61*e* is spaced apart from the gear 61*f*. Therefore, the rotation of the conveying roller 31 is transmitted to the gear 31*a*→gear 61*a*→gear 61*b*→gear 61*c*→gear 61*d*→gear 61*e*, but is not transmitted to the gear 61*f*. That is, the transmission of the driving force of the driving source 32 to the recovery unit 50 is interrupted, and the gear 61*e* is in an idling state.

FIG. 4B shows a state in which the recovery driving member 55 is displaced to the position X2. In this state, the recovery driving arm 611 pivots to press the gear 61*e* against the gear 61*f*, and the gears engage with each other. Therefore, the rotation of the conveying roller 31 is transmitted to the gear 31*a*→gear 61*a*→gear 61*b*→gear 61*c*→gear 61*d*→gear 61*e*→gear 61*f*.

A rack 62*a* that meshes with the gear 61*f* is formed in the control member 62, and the rotation of the gear 61*f* displaces the control member 62. This can transmit the driving force of the driving source 32 to the recovery unit 50, especially the control member 62.

The control member 62 is supported by the base member 54 to be reciprocally movable in the Y direction. The rack 62*a* is formed in the Y direction, and the driving force of the driving source 32 is input to the control member 62 via the gear 61*f* and the rack 62*a*, thereby moving the control member 62 in the Y direction.

In this embodiment, the control member 62 is a plate-shaped member including a plurality of cam portions, and causes the components of the recovery unit 50 to operate by moving. When the plurality of cam portions are formed in the single control member 62, and the components are operated, the components can be operated in coordination with each other, and the operation order can be controlled by the position of the control member 62.

The plurality of cam portions include a cam portion that vertically moves the cap 51 at a position corresponding to the position X2 of the printhead 12. This raises the cap 51 to a capping position and lowers the cap 51 to a position apart from the printhead 12. The plurality of cam portions include a cam portion that causes the wiper 52 to wipe the ink discharge surface of the printhead 12. Wiping is performed when the cap 51 is lowered, and the wiper 52 passes through a portion between the printhead 12 and the cap 51.

In this embodiment, preliminary discharge of the printhead 12 is performed by locating the printhead 12 at the position X1. An ink absorbing member (not shown) may receive discharged ink. The plurality of cam portions may include a cam portion that displaces the cap 51 in the X direction, and preliminary discharge may be performed for the cap 51 by displacing the cap 51 to a position corresponding to the position X1 of the printhead 12.

<Driving Transmission to Feeding Unit>

Figure 5:
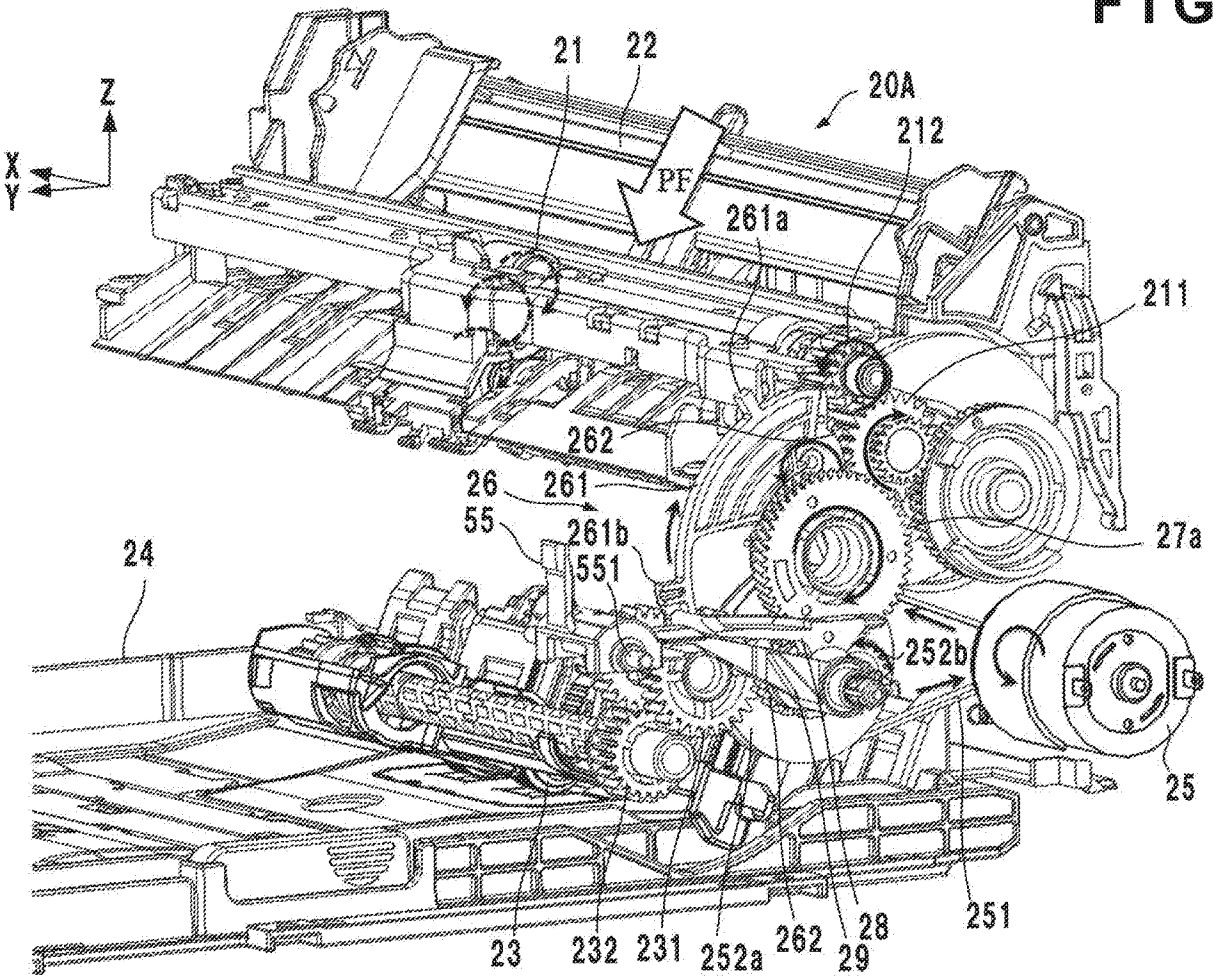
FIG. 5 is an explanatory view of driving transmission to two feeding units.
Figure 6:
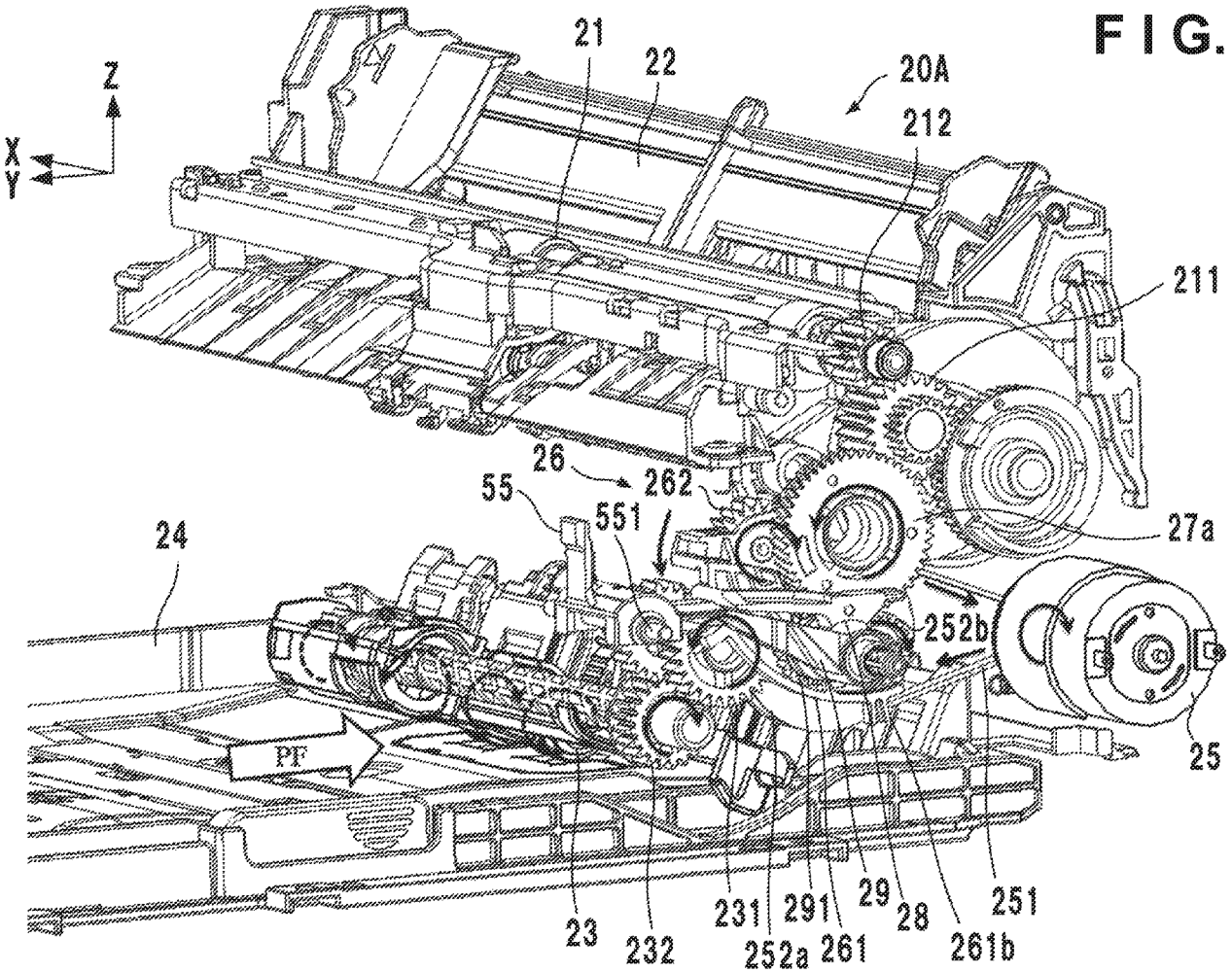
FIG. 6 is an explanatory view of driving transmission to the two feeding units.

The transmission of the driving force of the driving source 25 to the feeding unit 20A or 20B will be described. FIG. 5 shows a state in which the driving force is transmitted to the feeding unit 20A. FIG. 6 shows a state in which the driving force is transmitted to the feeding unit 20B.

A transmitting unit 26 selectively transmits the driving force to the feeding units 20A and 20B. The transmitting unit 26 is a mechanism that can be displaced to an upper transmitting position, a lower transmitting position, and a non-transmitting position. The upper transmitting position is a position (a position shown in FIG. 5) at which the driving force of the driving source 25 is transmitted to the feeding unit 20A. The lower transmitting position is a transmitting position (a position shown in FIG. 6) at which the driving force of the driving source 25 is transmitted to the feeding unit 20B. The non-transmitting position is a position at which the driving force is transmitted to neither the feeding unit 20A nor the feeding unit 20B.

In this embodiment, the transmitting unit 26 is a pendulum mechanism including a pendulum 261 that can swing coaxially with a sun gear 27*a,* and a planet gear 262 that is rotatably supported by the pendulum 261. The upper transmitting position, the lower transmitting position, and the non-transmitting position between them are included in the swing range of the transmitting unit 26. The feeding unit 20A includes a gear train including gears 211 and 212, and the feeding roller 21 is rotated by the driving force transmitted via the gear train. If the transmitting unit 26 is at the upper transmitting position shown in FIG. 5, the planet gear 262 meshes with the gears of the gear train of the feeding unit 20A, and the driving force of the driving source 25 is transmitted to the feeding roller 21. This feeds the printing medium in a direction indicated by an arrow PF in FIG. 5. The feeding unit 20B includes a gear train including gears 231 and 232, and a feeding roller 23 is rotated by the driving force transmitted via the gear train. If the transmitting unit 26 is at the lower transmitting position shown in FIG. 6, the planet gear 262 meshes with the gears of the gear train of the feeding unit 20B, and the driving force of the driving source 25 is transmitted to the feeding roller 23. This feeds the printing medium in the direction of the arrow PF in FIG. 6.

A restricting member 28 and a selecting member 29 are provided near the transmitting unit 26. The restricting member 28 is a member that can restrict the displacement of the transmitting unit 26 in coordination with the displacement of the recovery driving member 55. The selecting member 29 is a member that switches between coordination and non-coordination of the restricting member 28 with the recovery driving member 55. The transmitting unit 26, the restricting member 28, the selecting member 29, and their peripheral arrangement will be described with reference to FIGS. 7A to 8B.

The transmitting unit 26 is displaced by the driving force of the driving source 25. A pulley (not shown) is provided in the output shaft of the driving source 25, and a belt 251 is wound around the pulley and a rotating member 252. The rotating member 252 is rotatably supported around the X-direction axis, and includes a pulley 252*a* and a gear 252*b* that are fixed coaxially. The belt 251 is wound around the pulley 252*a,* and the rotating member 252 is rotated in accordance with the rotation direction of the driving source 25. The sun gear 27*a* of a rotating member 27 and a gear 291 mesh with the gear 252*b.*

The rotating member 27 is rotatably supported around the X-direction axis, and includes the sun gear 27*a* and a sun gear 27*b* coaxially. These gears 27*a* and 27*b* are fixed to a cylindrical shaft 27*c.*

The pendulum 261 of the transmitting unit 26 is swingably supported by the shaft 27*c,* and swings on the shaft 27*c.* The planet gear 262 meshes with the sun gear 27*b.* A friction spring (not shown) is provided between the pendulum 261 and the rotation center axis of the planet gear 262, and causes the pendulum 261 to swing in the same direction together with the rotation of the sun gear 27*b* (that is, the rotation of the rotating member 252).

Figure 7A:
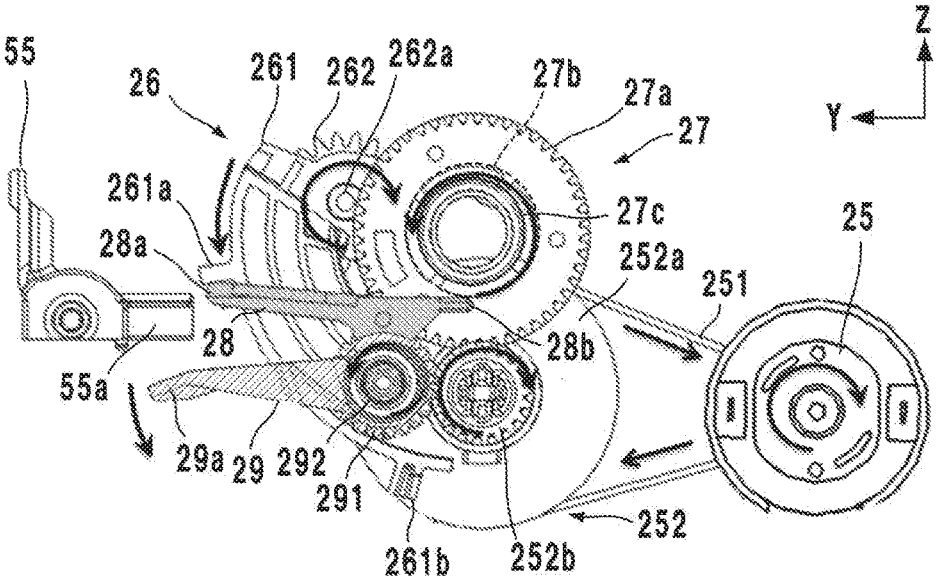
FIGS. 7A and 7B are explanatory views of a restricting member and a selecting member.

When rotating the driving source 25 in the clockwise direction in FIG. 7A, the rotating member 27 rotates in the counterclockwise direction, and the transmitting unit 26 also swings in the counterclockwise direction. When the transmitting unit 26 reaches the lower transmitting position, the planet gear 262 meshes with the gear train of the feeding unit 20B and stops, and the rotation of the rotating member 27 is transmitted to the gear train of the feeding unit 20B via the planet gear 262.

Figure 7B:
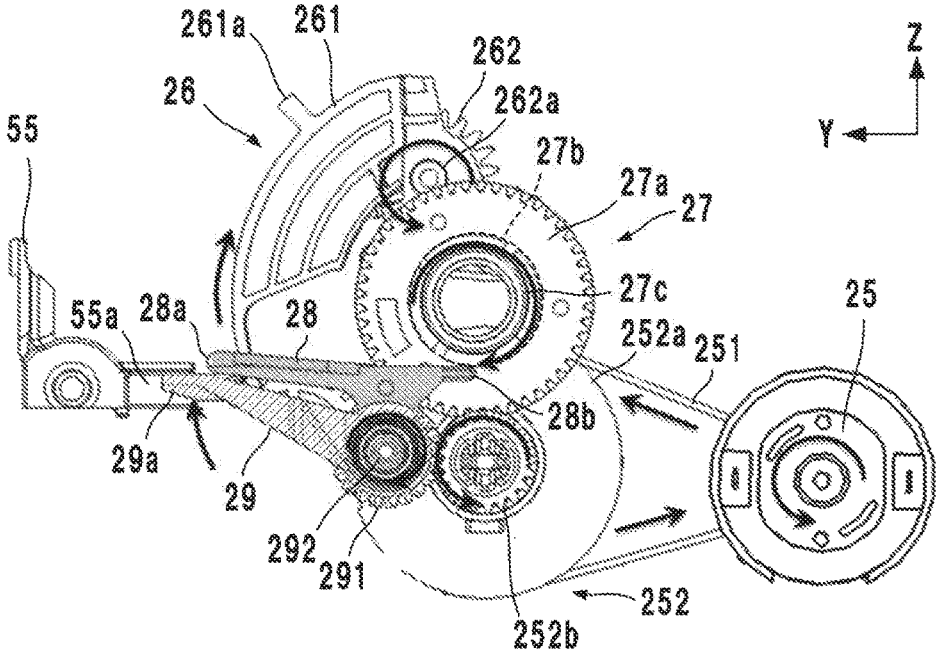

When rotating the driving source 25 in the counterclockwise direction in FIG. 7B, the rotating member 27 rotates in the clockwise direction, and the transmitting unit 26 also swings in the clockwise direction. When the transmitting unit 26 reaches the upper transmitting position, the planet gear 262 meshes with the gear train of the feeding unit 20A and stops, and the rotation of the rotating member 27 is transmitted to the gear train of the feeding unit 20A via the planet gear 262.

The restricting member 28 is supported by a shaft 292 extending in the X direction to be slidable in the X direction. An engaging portion 28*a* extending in the X direction is provided at one end of the restricting member 28. A slide portion 28*b* is provided at the other end of the restricting member 28. The slide portion 28*b* is in slidable contact with a rail (not shown) extending in the Y direction, and assists in displacing the restricting member 28 in the X direction while preventing the pivot of the restricting member 28 about the shaft 292.

Figure 8A:
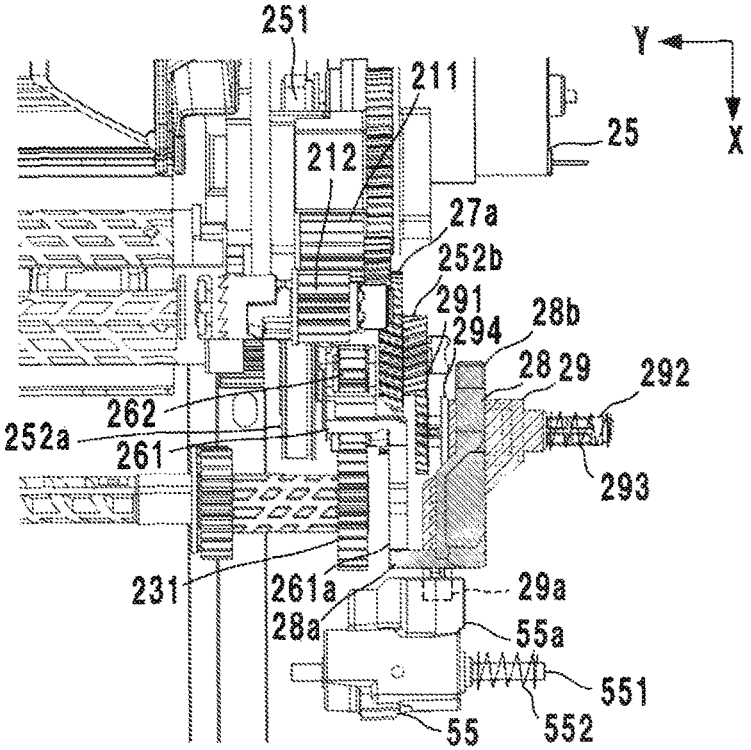
FIGS. 8A and 8B are explanatory views of the restricting member and the selecting member.
Figure 8B:
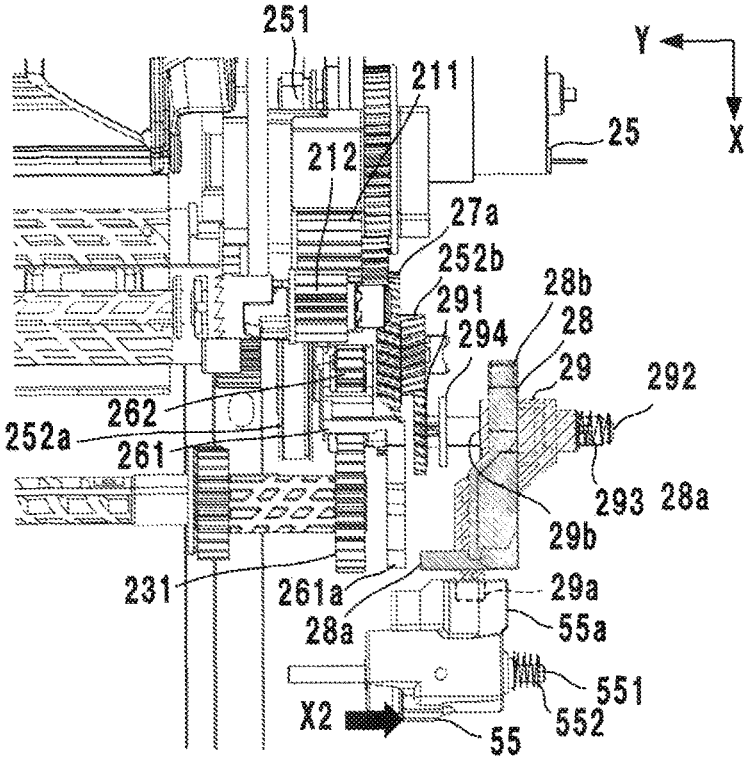

The pendulum 261 includes stoppers 261*a* and 261*b* each of which engages with the engaging portion 28*a.* The stoppers 261*a* and 261*b* are formed at positions apart from each other by a predetermined angle with respect to the swing center of the pendulum 261. In coordination with the displacement of the recovery driving member 55 between the positions X1 and X2, the restricting member 28 is displaced on the shaft 292 between a restricting position at which the engaging portion 28*a* engages with the stopper 261*a* or 261*b* and a non-restricting position at which the engaging portion 28*a* engages with none of the stoppers 261*a* and 261*b*. FIG. 8A shows a case in which the recovery driving member 55 is located at the position X1 and the restricting member 28 is located at the restricting position. FIG. 8B shows a case in which the recovery driving member 55 is located at the position X2 and the restricting member 28 is located at the non-restricting position. At the restricting position, the engaging portion 28*a* is located on the moving orbit of the stoppers 261*a* and 261*b*. At the non-restricting position, the engaging portion 28*a* is located at a position deviated in the X direction from the moving orbit of the stoppers 261*a* and 261*b*.

The selecting member 29 is provided between the recovery driving member 55 and the restricting member 28, and switches between coordination and non-coordination of the restricting member 28 with the recovery driving member 55. In this embodiment, the selecting member 29 is a lever member that pivots about the shaft 292 inserted therethrough and can slide along the shaft 292. The selecting member 29 includes a portion that abuts against two sides of the restricting member 28 in the X direction on the shaft 292. When this portion abuts against the restricting member 28, the selecting member 29 is displaced in the X direction along the shaft 292 integrally with the restricting member 28.

An engaging portion 29*a* that engages with an engaging portion 55*a* of the recovery driving member 55 is provided in the distal end portion of the selecting member 29. FIG. 7A shows a state in which the selecting member 29 is located at a non-coordinating position at which the engaging portion 29*a* shifts in the Z direction with respect to the engaging portion 55*a* and thus does not engage with the engaging portion 55*a*. FIG. 7B shows a state in which the selecting member 29 is located at a coordinating position at which the engaging portion 29*a* does not shift in the Z direction with respect to the engaging portion 55*a* and thus engages with the engaging portion 55*a*. The coordinating position is a position at which the restricting member 28 is coordinated with the displacement of the recovery driving member 55. The non-coordinating position is a position at which the restricting member 28 is not coordinated with the displacement of the recovery driving member 55.

If the recovery driving member 55 is displaced from the position X1 to the position X2 while the selecting member 29 is located at the coordinating position, the selecting member 29 is displaced in the X direction together with the recovery driving member 55 and the restricting member 28 is also displaced in the X direction. FIGS. 8A and 8B show a state in which while the selecting member 29 is located at the coordinating position, the recovery driving member 55 is displaced from the position X1 (FIG. 8A) to the position X2 (FIG. 8B). The selecting member 29 and the restricting member 28 are displaced in coordination with the displacement of the recovery driving member 55, and the restricting member 28 is displaced from the restricting position to the non-restricting position.

Even if the recovery driving member 55 is displaced from the position X1 to the position X2 while the selecting member 29 is located at the non-coordinating position, the selecting member 29 is not displaced in the X direction together with the recovery driving member 55 and the restricting member 28 is not displaced either. If the restricting member 28 is biased to the restricting position by a spring 293 via the selecting member 29, and is not coordinated with the recovery driving member 55, it is located at the restricting position.

Figure 9A:
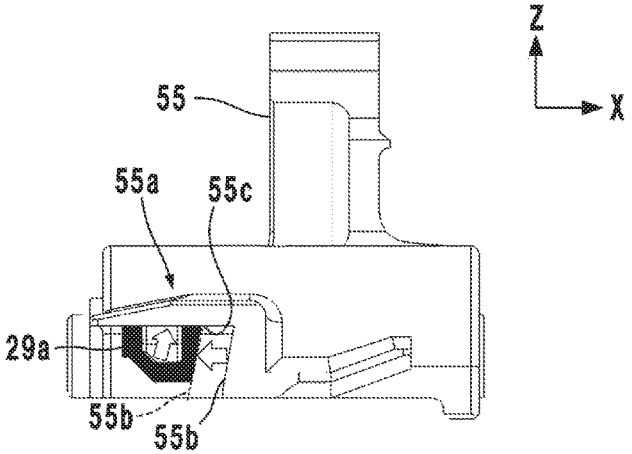
FIG. 9A is an explanatory view of engaging portions.

FIG. 9A shows the engaging state between the engaging portions 55*a* and 29*a*. As shown in FIG. 9A, the engaging portion 55*a* has a concave shape including an upper wall portion 55*c* and a right wall portion 55*b* in FIG. 9A. Referring to FIG. 9A, the engaging portion 29*a* is represented by a cross section (black portion), and has a C-shaped cross section that is open upward. The wall portion 55*b* is formed by an inclined surface. As indicated by a broken line, this surface is inclined to guide the engaging portion 29*a* toward the wall portion 55*c* by the displacement of the recovery driving member 55 from the position X1 to the position X2. When the engaging portion 29*a* is guided by the inclination of the wall portion 55*b* to be pressed against the wall portion 55*c*, engagement between the engaging portions 29*a* and 55*a* is not canceled easily. That is, the displacement of the selecting member 29 from the coordinating position to the non-coordinating position is restricted.

The displacement of the selecting member 29 between the coordinating position and the non-coordinating position may be driven by a dedicated actuator. In this embodiment, however, the displacement is driven by the driving force of the driving source 25. As shown in FIGS. 7A and 7B, when the rotating member 252 is rotated by driving of the driving source 25, the gear 252*b* is rotated, and the gear 291 that meshes with the gear 252*b* is rotated. As shown in FIGS. 8A and 8B, the gear 291 is fixed to the shaft 292, and is rotated about the shaft 292. A friction plate 294 is fixed to the shaft 292. As shown in FIG. 8A, the spring 293 generally presses a side surface 29*b* of the selecting member 29 against the friction plate 294. When the shaft 292 is rotated by the rotation of the gear 291, the friction force between the friction plate 294 and the side surface 29*b* exerts a rotating force on the selecting member 29, and thus the selecting member 29 pivots. By switching the rotation direction of the driving source 25, the selecting member 29 can be displaced (caused to pivot) between the coordinating position and the non-coordinating position. The pivot range of the selecting member 29 is restricted by a stopper (not shown). The friction plate 294 and the side surface 29*b* form a torque limiter, and slide when the selecting member 29 reaches the pivot limit. As described above, by providing the torque limiter in the transmitting path of the driving force of the driving source 25 to the selecting member 29, the pivot range of the selecting member 29 has no influence on driving of the driving source 25.

Since the mechanism of driving transmission to the feeding units 20A and 20B has the above-described arrangement, for example, the following operation is possible.

When performing a recovery operation without driving the feeding units 20A and 20B, for example, the state shown in FIG. 7A is set. In the state shown in FIG. 7A, the driving source 25 rotates in the clockwise direction, and the transmitting unit 26 and the selecting member 29 pivot in the counterclockwise direction. The restricting member 28 is located at the restricting position and the transmitting unit 26 is held at the non-transmitting position by restricting the pivot. The selecting member 29 is displaced to the non-coordinating position. In this state, even if the carriage 11 is moved from the position X1 to the position X2 to displace the recovery driving member 55 to the position X2, the restricting member 28 remains at the restricting position. The driving force of the driving source 32 is input to the recovery unit 50 to allow a negative-pressure suction operation by the cap 51 and wiping by the wiper 52 to be performed. At the time of the negative-pressure suction operation, the driving source 25 is driven to drive the pump 53. However, no driving force is transmitted to the feeding units 20A and 20B, and thus the printing medium is never fed. That is, the pump 53 and the feeding units 20A and 20B can be exclusively driven.

When driving the feeding unit 20A or 20B, for example, the state shown in FIG. 7B is set. In the state shown in FIG. 7B, the driving source 25 rotates in the counterclockwise direction, the transmitting unit 26 and the selecting member 29 pivot in the counterclockwise direction, and the selecting member 29 is displaced to the coordinating position and engages with the engaging portion 55*a* of the recovery driving member 55. In this state, the restricting member 28 can be displaced to the non-restricting position (for example, FIG. 8B) by moving the carriage 11 from the position X1 to the position X2 and thus displacing the recovery driving member 55 to the position X2.

After that, the transmitting unit 26 is displaced to the upper transmitting position or lower transmitting position by driving the driving source 25 in a rotation direction corresponding to the feeding unit 20A or 20B to be driven. This can drive the feeding unit 20A or 20B. In this embodiment, if the driving source 25 is rotated in one direction, the transmitting unit 26 is displaced to the upper transmitting position and the feeding unit 20A is driven. If the driving source 25 is rotated in the opposite direction, the transmitting unit 26 is displaced to the lower transmitting position and the feeding unit 20B is driven.

In this embodiment, in the mechanism of switching the operation of the restricting member 28 using the movement of the carriage 11, the selecting member 29 can switch and select the operation of the restricting member 28. As a result, it is possible to exclusively drive the pump 53 and the feeding units 20A and 20B, and perform driving selection between the feeding units 20A and 20B.

In this embodiment, by coordinating the restricting member 28 with the displacement of the recovery driving member 55, the recovery driving member 55 is used not only to interrupt the driving force to the recovery unit 50 but also to switch displacement restriction of the transmitting unit 26. That is, it is not necessary to provide a dedicated movable member on the moving path of the carriage 11 in order to switch the displacement restriction of the transmitting unit 26. This contributes to a decrease in number of necessary stop positions of the carriage 11 and a decrease in number of movable members on the moving path of the carriage 11, thereby contributing to a decrease in length of the printing apparatus 1 in the main scanning direction.

<Control Unit>

Figure 9B:
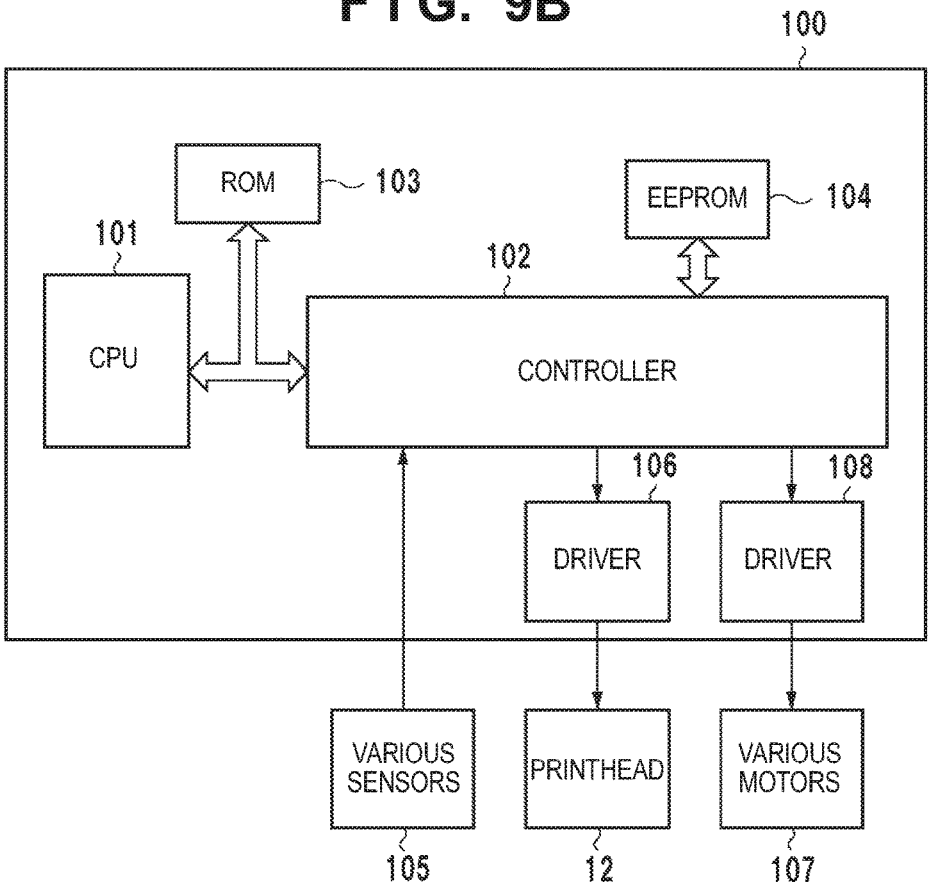
FIG. 9B is a block diagram of a control unit.

The arrangement of the control system of the printing apparatus 1 will be described with reference to FIG. 9B. FIG. 9B is a block diagram of a control unit 100 that controls the printing apparatus 1. The control unit 100 is a control circuit that controls the operation of each mechanical unit of the printing apparatus 1. A CPU 101 controls the entire printing apparatus 1. A controller 102 assists the CPU 101 and controls driving of various motors 107 and the printhead 12 in accordance with detection results of various sensors 105.

Various kinds of data and the control program of the CPU 101 are stored in a ROM 103. Various kinds of data are stored in an EEPROM 104. Note that as the ROM 103 and the EEPROM 104, other storage devices may be employed.

A driver 108 drives the various motors 107. The various motors 107 include, for example, motors serving as the driving sources 25, 32, and 13. A driver 106 drives the printhead 12. The various sensors 105 include a sensor that detects the position of the carriage 11, and a sensor disposed in the conveying path of the printing medium to detect the printing medium.

A printing operation starts when, for example, a print job is received from a host computer, or a print job to print an original read by the scanner unit 3 on a printing medium is generated.

Figure 10:
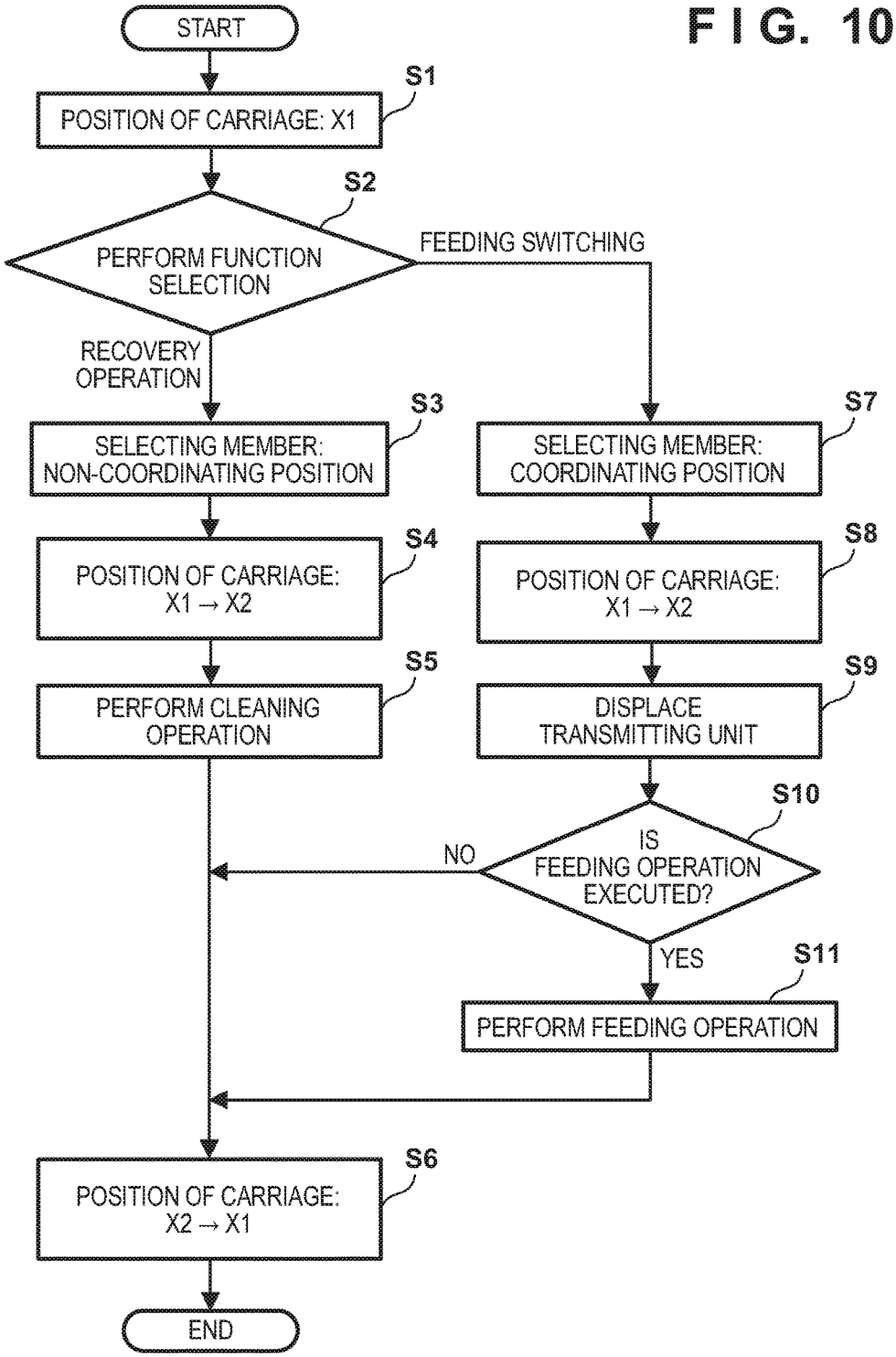
FIG. 10 is a flowchart illustrating a control example.

FIG. 10 is a flowchart illustrating an example of control executed by the CPU 101, and exemplifies processing associated with driving of the feeding units 20A and 20B and recovery unit 50.

When performing a recovery operation or feeding operation, the CPU 101 moves the carriage 11 to the position X1 in step S1 and then stands by. The transmitting unit 26 is located at the non-transmitting position. In step S2, function selection is performed. In this example, whether to perform the feeding operation or the recovery operation (cleaning operation) is selected. If the recovery operation is performed, the process advances to step S3. If the feeding operation is performed, the process advances to step S7.

In step S3, the driving source 25 is driven to locate the selecting member 29 at the non-coordinating position. In step S4, the carriage 11 is moved from the position X1 to the position X2. This displaces the recovery driving member 55 from the position X1 to the position X2, thereby obtaining a state in which the driving force can be transmitted from the driving source 32 to the recovery unit 50. In step S5, negative-pressure suction by the cap 51 and wiping by the wiper 52 are performed. In step S6, the carriage 11 is returned to the position X1.

In step S7, the driving source 25 is driven to locate the selecting member 29 at the coordinating position. In step S4, the carriage 11 is moved from the position X1 to the position X2. This displaces the recovery driving member 55 from the position X1 to the position X2 and, in coordination with the displacement, the restricting member 28 is displaced to the non-restricting position. In step S9, the driving source 25 is driven to displace the transmitting unit 26 to the upper transmitting position or the lower transmitting position. In step S10, it is determined whether to execute the feeding operation immediately. If the feeding operation is not executed immediately, the process advances to step S6; otherwise, the feeding operation is performed in step S11 and the process advances to step S6. Then, the processing of one unit ends.

<Other Mechanism Examples>

In the above embodiment, the operation mechanisms that are exclusively driven are the feeding units and pump. The present invention, however, is not limited to them, and is applicable to other operation mechanisms.

In the above embodiment, the two feeding units are provided. However, one feeding unit may be provided. In this case, the transmitting unit 26 may be allowed to switch between a driving transmitting state and non-transmitting state for the one feeding unit.

In the above embodiment, translation or pivot is exemplified as displacement of a member. Either translation or pivot may be used within a range of forming a mechanism.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2016-151526, filed Aug. 1, 2016, which is hereby incorporated by reference herein in its entirety.

What is claimed is:

1. A printing apparatus comprising:

a printhead configured to print an image on a printing medium;

a carriage, on which the printhead is mounted, configured to move;

a driving source;

an operating unit configured to operate by a driving force of the driving source;

a transmitting unit configured to be displaced by the driving force of the driving source between a transmitting position at which the transmitting unit transmits the driving force of the driving source to the operating unit and a non-transmitting position at which the transmitting unit does not transmit the driving force of the driving source to the operating unit;

a movable member arranged on a moving path of the carriage and configured to be displaced by the movement of the carriage;

a restricting member configured to be displaced, in coordination with a displacement of the movable member, between a restricting position at which the displacement of the transmitting unit is restricted by the restricting member and a non-restricting position; and a selecting member provided between the movable member and the restricting member and configured to be displaced between a coordinating position at which the movable member and the restricting member are coordinated with each other by the selecting member and a non-coordinating position at which the movable member and the restricting member are not coordinated with each other by the selecting member.

2. The apparatus according to claim 1, wherein the operating unit comprises a feeding unit configured to feed the printing medium.

3. The apparatus according to claim 1, wherein the printhead prints the image by discharging ink to the printing medium, the printing apparatus further comprises a recovery unit configured to perform a recovery operation of the printhead, and switching is performed between transmission and interruption of the driving force to the recovery unit in coordination with the displacement of the movable member.

4. The apparatus according to claim 3, wherein the carriage is capable of moving so that the printhead moves across a printing region where a printing operation by the printhead is performed and a standby region adjacent to the printing region, the recovery unit is provided in the standby region, the printhead is capable of moving between a cleaning position and a preliminary discharge position in the standby region by the movement of the carriage, the preliminary discharge position is a position closer to the printing region than the cleaning position, and when the carriage moves from the preliminary discharge position to the cleaning position, the movable member is displaced and the driving force is transmitted to the recovery unit.

5. The apparatus according to claim 4, wherein when the selecting member is located at the coordinating position, the restricting member is displaced from the restricting position to the non-restricting position by the displacement of the movable member along with the movement of the carriage from the preliminary discharge position to the cleaning position.

6. The apparatus according to claim 1, wherein the restricting member is provided to be displaceable in a moving direction of the carriage between the restricting position and the non-restricting position together with the selecting member, the coordinating position is a position at which the selecting member engages with the movable member, and the non-coordinating position is a position at which the selecting member does not engage with the movable member.

7. The apparatus according to claim 6, wherein the selecting member pivots by the driving force of the driving source while a pivot range is restricted between the coordinating position and the non-coordinating position, and a torque limiter is provided in a transmitting path of the driving force of the driving source to the selecting member.

8. The apparatus according to claim 6, wherein the movable member includes an engaging portion configured to restrict the displacement of the selecting member engaging with the movable member from the coordinating position to the non-coordinating position.

9. The apparatus according to claim 1, wherein the movable member and the selecting member are arranged side by side in a direction crossing a moving direction of the carriage.

10. The apparatus according to claim 1, wherein the operating unit comprises a first feeding unit and a second feeding unit, the transmitting position comprises a first transmitting position at which the driving force of the driving source is transmitted to the first feeding unit and a second transmitting position at which the driving force of the driving source is transmitted to the second feeding unit, and the non-transmitting position is a position at which the driving force of the driving source is transmitted to neither the first feeding unit nor the second feeding unit.

11. The apparatus according to claim 10, wherein the transmitting unit includes a swingable pendulum, and a planet gear rotatably supported by the pendulum, the planet gear meshes with a sun gear provided coaxially with a swing center of the pendulum, the first transmitting position, the second transmitting position, and the non-transmitting position between the first transmitting position and the second transmitting position are included in a swing range of the pendulum, the driving source comprises a motor, and the pendulum is displaced to the first transmitting position when the motor rotates in a first direction, and to the second transmitting position when the motor rotates in a second direction.

12. The apparatus according to claim 1, further comprising:

a control unit configured to control the driving source.

* * * * *